US006592680B2

(12) United States Patent
Christison et al.

(10) Patent No.: US 6,592,680 B2
(45) Date of Patent: Jul. 15, 2003

(54) INTEGRATED CIRCUIT ASSEMBLY CLEANING APPARATUS AND METHOD

(75) Inventors: Pamela L Christison, Fort Collins, CO (US); Lawrence E. Houdek, Loveland, CO (US); John Pratt, Fort Collins, CO (US); Russell Bjorlie, Loveland, CO (US); William H Hanna, Fort Collins, CO (US); Perry H. Pierce, Fort Collins, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 110 days.

(21) Appl. No.: 09/814,446

(22) Filed: Mar. 22, 2001

(65) Prior Publication Data

US 2002/0134408 A1 Sep. 26, 2002

(51) Int. Cl.[7] ..... B08B 3/04

(52) U.S. Cl. ..... 134/26; 134/25.4; 134/33; 134/140; 134/157; 134/164; 134/902

(58) Field of Search ..... 134/25.4, 26, 33, 134/140, 142, 157, 164, 902

(56) References Cited

U.S. PATENT DOCUMENTS

| | | | | | |
|---|---|---|---|---|---|
| 5,327,921 | A | * | 7/1994 | Mokuo et al. | 134/182 |
| 6,062,239 | A | * | 5/2000 | Bexten | 134/25.4 |
| 6,086,457 | A | * | 7/2000 | Perlov et al. | 451/41 |
| 6,374,837 | B2 | * | 4/2002 | Scranton et al. | 134/161 |
| 6,386,213 | B1 | * | 5/2002 | Hung et al. | 134/140 |

* cited by examiner

*Primary Examiner*—Zeinab El-Arini
(74) *Attorney, Agent, or Firm*—Kyle J. Way

(57) ABSTRACT

An integrated circuit assembly cleaning apparatus and method allow a cleaning solution to completely fill spaces within an integrated circuit assembly. Such spaces include, for example, the thin space between the die and substrate of a flip-chip integrated circuit. The cleaning solution fills the space while the air initially occupying the space escapes. These actions are accomplished by first tilting the integrated circuit assembly from horizontal. The integrated circuit assembly is then immersed in the bath at a controllable rate to allow the cleaning solution to completely fill the space while the air in the space escapes.

16 Claims, 8 Drawing Sheets

INTEGRATED CIRCUIT ASSEMBLY CLEANING APPARATUS AND METHOD

BACKGROUND OF THE INVENTION

The continuing increases in the functional capacity of integrated circuits (ICs) over the last few years have been both astounding and beneficial. However, accompanying these increases are attendant technical problems that demand creative solutions. One such problem has been the increase in input/output (I/O) pads that typically result from increases in the amount of circuitry that can be incorporated onto an IC. The number of I/O pads on a traditional wire-bonded IC, which involves bonding wires from the I/O pads of the IC die to the substrate, is generally limited by the length of the IC perimeter because such I/O pads typically reside at the edges of the IC. Thus, reductions in the size of transistors and other electronic devices incorporated on a single die generally create a need for more I/O pads than what traditional wire-bonding technology can offer.

To satisfy this need, alternatives to wire-bonding techniques have been devised to increase the overall interconnection density of ICs. One such alternative is the "flip chip," which utilizes I/O connections across the top surface of the die. Thus, the connections are not restricted to the perimeter of the IC. Typically, solder "bumps" are formed on these connections. The solder bumps are then covered with solder flux, the die is flipped over so that the bumps make contact with the connection points of the IC substrate, and the die-substrate assembly is heated to reflow the solder. Hence, the necessary electrical contacts between the die and substrate are made by way of the solder bumps with the aid of the solder flux. FIG. 1 is a simplified perspective view of a typical flip chip assembly 100, with a die 110 connected to a substrate 120 by way of solder bumps 130, with die 110 and substrate 120 defining a narrow, substantially planar space 140 therebetween.

Tests on flip chip devices have shown that repeated heating and cooling of the IC during normal use tends to place sufficient thermal stress on the integrated circuit (die-substrate) assembly to cause some of the connections made via solder bumps 130 to break, creating electrical discontinuities between die 110 and substrate 120. To prevent such breaks, an underfill material (generally an adhesive) is normally employed to fill planar space 140 to maintain the structural integrity of the assembly and prevent the electrical connections from breaking. However, after the solder reflow, some flux residue remains in planar space 140 that must be removed by way of an IC cleaning solution before the underfill can be applied. The cleaning process is vital since leftover residue within planar space 140 prevents the underfill from reaching the entirety of planar space 140, thus adversely affecting the structural integrity and overall reliability of flip chip assembly 100.

Complete cleaning of the flux residue from planar space 140 of flip chip assembly 100 has proven to be rather difficult. The distance between die 110 and substrate 120 is normally quite narrow, on the order of 70 um or less. Further complicating the process is the fact that several rows of solder bumps 130 may exist in planar space 140, thus making access to all of planar space 140 even more problematic.

Currently, IC assemblies are normally cleaned using commercially available centrifugal cleaners and cleaning solutions. As shown in a simplified manner in FIG. 2, a centrifugal cleaner 200 employs a tank 210 that is filled with an IC cleaning solution 220 during the cleaning process. Centrifugal cleaner 200 usually holds several IC assemblies, such as flip chip assembly 100, using a cleaning fixture 230 immersed in cleaning solution 220 inside tank 210. A tank-filling mechanism (not shown) of centrifugal cleaner 200 is used to fill tank 210 with IC cleaning solution 220. Cleaning fixture 230 is then spun or agitated on a central vertical axis in cleaning solution 220 by way of a motor 240. Cleaning solution 220 is then drained from tank 210, and water rinse and spin-drying cycles in centrifugal cleaner 200 then normally follow. Cleaning fixture 230 holds several flip chip assemblies 100, or other similar IC assemblies, horizontally within IC cleaning solution 220.

Cleaning fixture 230 may be implemented in a variety of ways. For example, cleaning fixture 230 may consist of a central carousel to which one or more cassettes are attached. Each carousel would then be loaded manually with flip chip assemblies 100 prior to the cleaning process. Also, flip chip assemblies 100 may be held in boats 300 (FIG. 3), each of which holds several flip chip assemblies 100 throughout a majority of the IC manufacturing process. In that case, a cleaning fixture holds several such boats 300 containing flip chip assemblies 100 to be cleaned. Other methods of implementing cleaning fixture 230 not disclosed herein are also employed in the industry.

Unfortunately, as displayed in FIG. 4, which shows a top view of flip chip assembly 100 after being agitated or spun in a bath of cleaning solution 220 in centrifugal cleaner 200, tests have shown that cleaning solution 220 almost always fails to penetrate the entirety of planar space 140 (not shown explicitly in FIG. 4) between die 110 and substrate 120, leaving some flux residue behind because an air pocket 400 becomes trapped in planar space 140. When flip chip assembly 100 is positioned horizontally, cleaning solution 220 encroaches from all sides of planar space 140 simultaneously, trapping air pocket 400 approximately in the center of planar space 140. Air pocket 400 then acts as a countervailing force against the entry of cleaning solution 220 into planar space 140. Cleaning solution 220 is thus prevented from reaching all of planar space 140, allowing some of the flux residue from the solder reflow phase to remain. The remaining flux residue thus prohibits the underfill material subsequently applied from occupying all of planar space 140. Tests also confirm that no amount of spinning or agitation in cleaning solution 220 will force air pocket 400 from planar space 140 so that cleaning solution 220 may occupy all of planar space 140.

To remedy this problem, the use of a apparatus and method of cleaning the tight spaces in integrated circuit assemblies, such as, for example, between the die and substrate of a flip-chip IC, that would result in the complete removal of the flux residue in the space would be advantageous. Without any flux residue present in the planar space, the underfill material to be applied for purposes of structural integrity may fill all of the space, thus preventing the breakage of the various connections between the substrate and die. The cleaning of other types of integrated circuit assemblies involving similar tight spaces, such as, for example, ball grid arrays (BGAs) and direct chip attach (DCA) assemblies, whereby a die is attached directly to a printed circuit board (PCB), would also benefit from such an apparatus and method.

SUMMARY OF THE INVENTION

Specific embodiments according to the present invention, to be described herein, provide an effective way of cleaning a space within an integrated circuit assembly without trapping air inside the space. For example, one embodiment of the invention provides a method of cleaning an IC assembly, such as a flip chip IC. To allow the cleaning solution to enter the space without trapping an air pocket inside, the IC assembly is held at an incline from horizontal. The IC assembly is then immersed slowly in the cleaning solution so that the space is completely filled with the cleaning solution prior to the integrated circuit assembly becoming completely submerged within the solution. Since the cleaning solution fills all of the space, all flux residue will be dissolved, allowing the underfill material used later in the IC manufacturing process to fill the entire space, helping to create a structurally reliable IC assembly.

Another embodiment of the invention involves an IC cleaning apparatus that holds an IC assembly at an incline from horizontal. The IC assembly is usually retained either directly or indirectly by a cleaning fixture. The cleaning apparatus then slowly immerses the IC assembly in the cleaning solution bath so that the cleaning solution completely fills the space, thereby allowing air in the space to escape prior to total submergence of the IC assembly in the solution.

Other aspects and advantages of the invention will become apparent from the following detailed description, taken in conjunction with the accompanying drawings, illustrating by way of example the principles of the invention.

DETAILED DESCRIPTION

Figure 1:
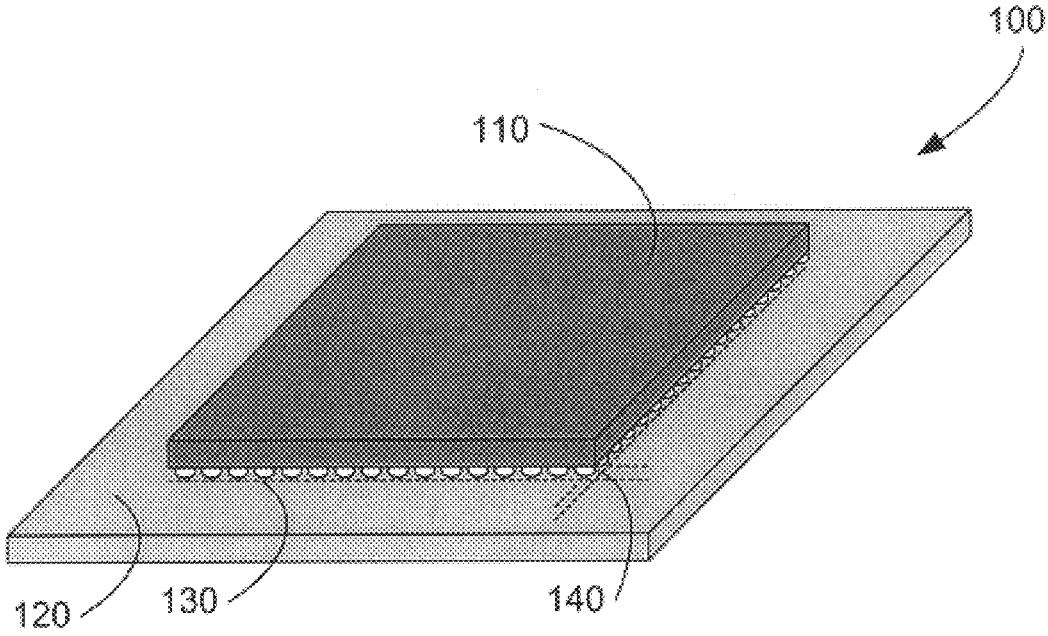
FIG. 1 PRIOR ART
FIG. 1 is a simplified perspective view of a typical flip chip IC assembly according to the prior art.

An IC assembly cleaning apparatus according to an embodiment of the invention utilizes a version of centrifugal cleaner 200 (of FIG. 2) having a cleaning fixture that holds IC assemblies to be cleaned at an incline from horizontal. (All of the embodiments discussed below involve a centrifugal cleaner, although other type of IC cleaners may also utilize the principles of the invention described herein.) The IC assemblies define a narrow space that contains flux residue to be removed. As described earlier, one such type of IC assembly is flip chip assembly 100 (of FIG. 1), in which die 110 and substrate 120 define substantially planar space 140, which contains flux residue to be removed before space 140 is filled with an adhesive. In one embodiment, depicted in FIG. 5, a first cleaning fixture 500 employs removable cassettes 510 that are attached to a central carousel 520. Each cassette 510 holds several flip chip assemblies 100 at an incline of approximately 30 degrees from horizontal. In another embodiment, shown in FIG. 6, a second cleaning fixture 600 is capable of holding one or more IC assembly boats 300 (from FIG. 3), each of which may hold several flip chip assemblies 100 to be cleaned. Boats 300 are attached to cleaning fixture 600 via slots 610. In the particular embodiment of FIG. 6, boat 300 is held at an incline of 45 degrees from horizontal. In another embodiment, a third cleaning fixture 700 holds flip chip assemblies 100 directly in a circular fashion in slots (not shown). In the particular embodiment of FIG. 7, flip chip assemblies 100 are maintained at an angle of 90 degrees from horizontal. With respect to any of the embodiments of FIGS. 5, 6, and 7, the IC assembly cassettes or boats may be held within the cleaning fixture using methods employed in prior art cleaning fixtures that orient the IC assemblies horizontally. Additionally, other cleaning fixture configurations not specifically mentioned herein may also be utilized, provided that the IC assemblies are held at an angle from horizontal.

Figure 2:
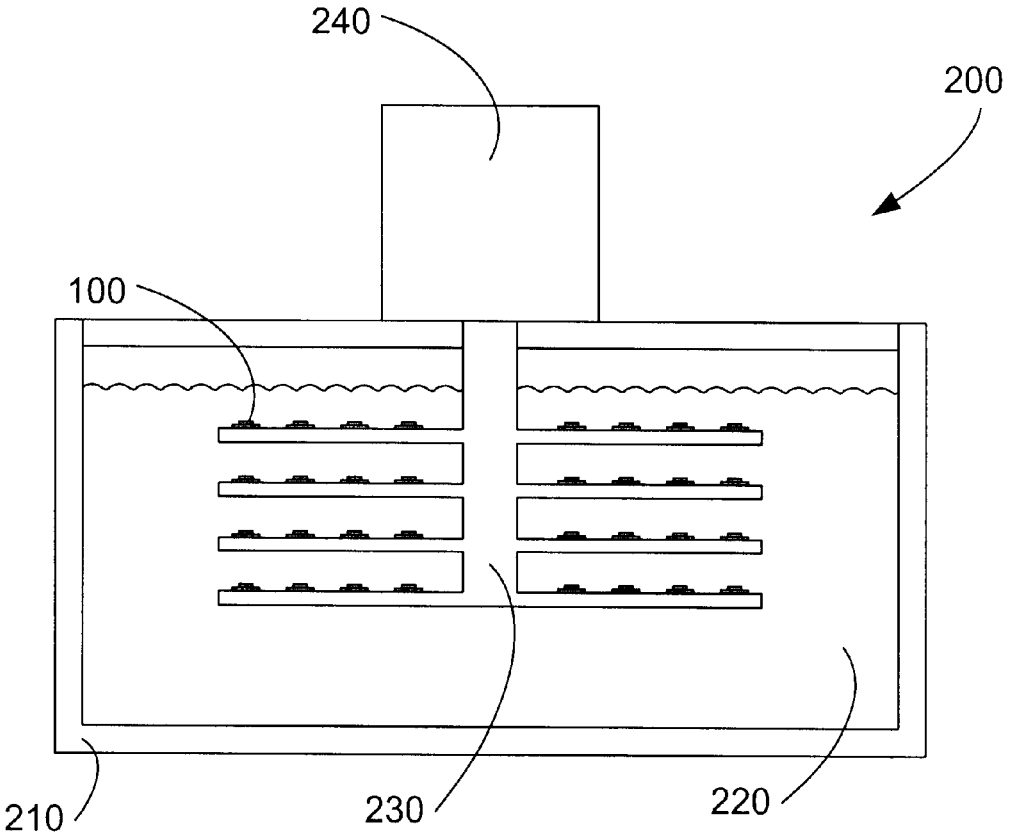
FIG. 2 PRIOR ART
FIG. 2 is a simplified cross-sectional side view of an IC centrifugal cleaner according to the prior art.
Figure 3:
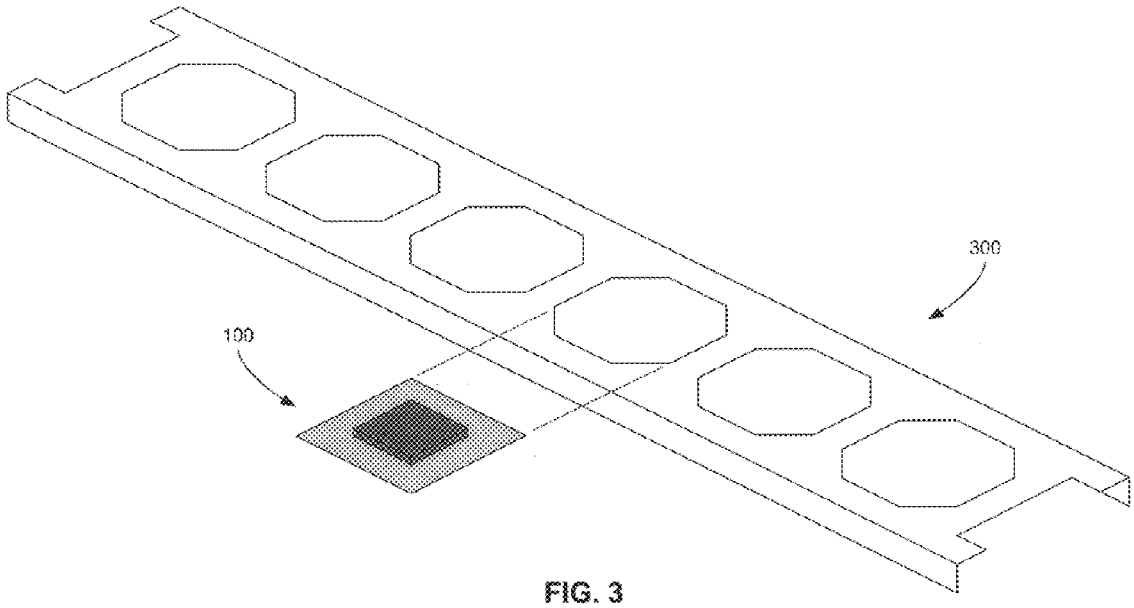
FIG. 3 PRIOR ART
FIG. 3 is a simplified perspective view of a boat that holds flip chip IC assemblies during the IC manufacturing process according to the prior art.
Figure 4:
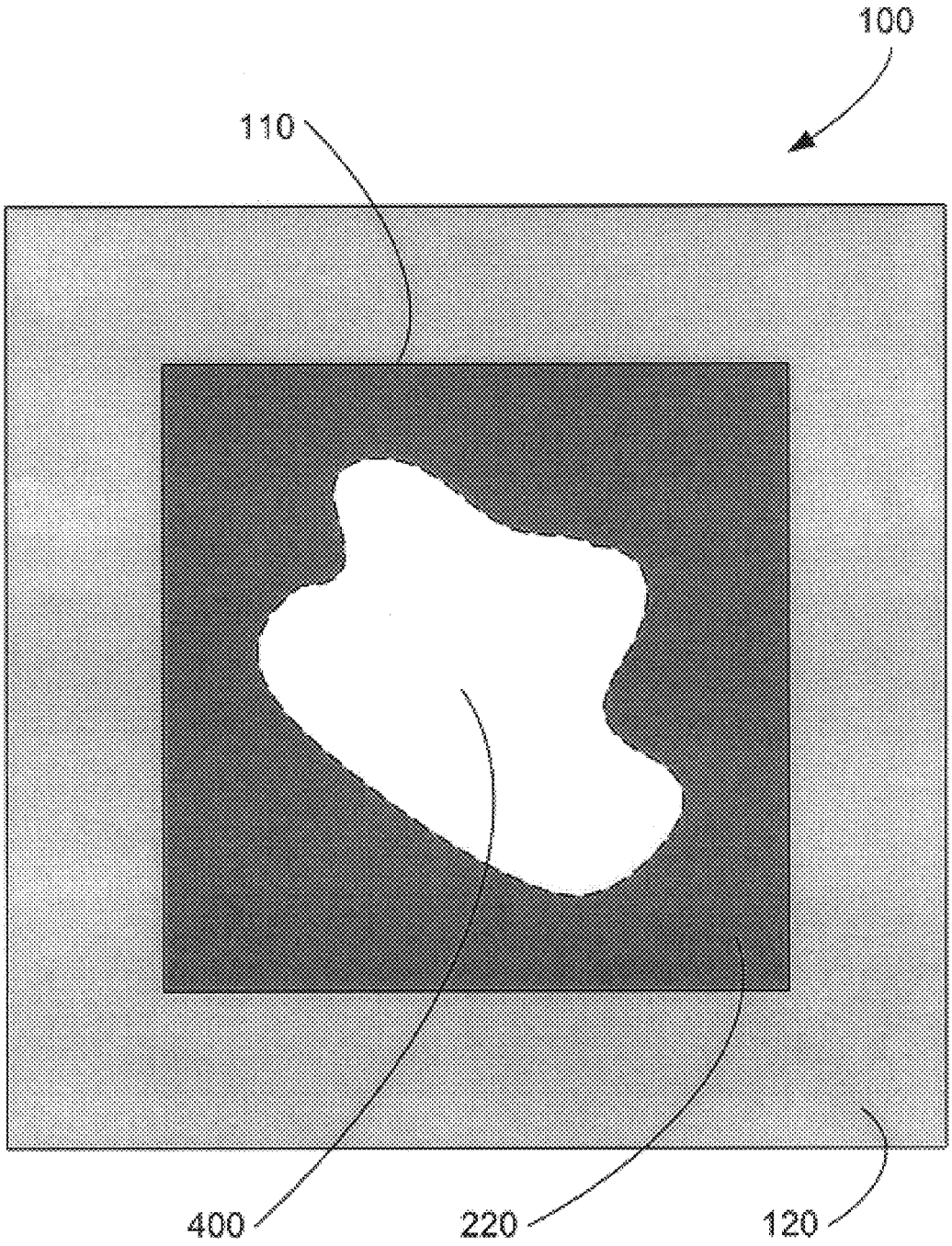
FIG. 4 PRIOR ART
FIG. 4 is a simplified plan view of the flip chip IC assembly after being spun or agitated while submerged horizontally according to the prior art in the IC cleaning solution in the centrifugal cleaner of FIG. 2.

Flip chip assemblies 100, while held at an incline from horizontal, are placed in contact with the surface of a bath of IC cleaning solution 220 in tank 210 (from FIG. 2). According to one embodiment, cleaning fixture 500, 600, or 700 is lowered into tank 210 that is already filled with cleaning solution 200. More likely, cleaning fixture 500, 600, or 700 is first lowered into an empty tank 210, and then tank 210 is filled with cleaning solution 220 until the surface of cleaning solution 220 makes contact with flip chip assemblies 100 such that cleaning solution 220 enters planar space 140, possibly being drawn into planar space 140 by capillary action. While cleaning solution 220 is filling planar space 140, at least some of the perimeter of planar space 140 is not submerged in cleaning solution 220, due to the inclined orientation of planar space 140. The inclined position of flip chip assemblies 100 allows any air within planar space 140 to escape while cleaning solution 220 continues to enter planar space 140.

To allow air to escape from planar space 140, flip chip assemblies 100 must be positioned in cleaning solution 220 such that only a portion of the perimeter of planar space 140 is submerged. This positioning is accomplished in one embodiment by controlling the descent of flip chip assemblies 100 into cleaning solution 220, in the case that tank 210 is already filled with cleaning solution 220. Alternately, in the case that cleaning fixture 500, 600, or 700 already resides within tank 210, the filling of tank 210 with cleaning solution 220 is controlled so that the surface of the bath of cleaning solution 220 rises slowly enough to allow planar space 140 to be completely filled with cleaning solution 220 prior to the entire perimeter of planar space 140 becoming submerged, thus allowing all air in planar space 140 to escape prior to submergence.

Figure 6:
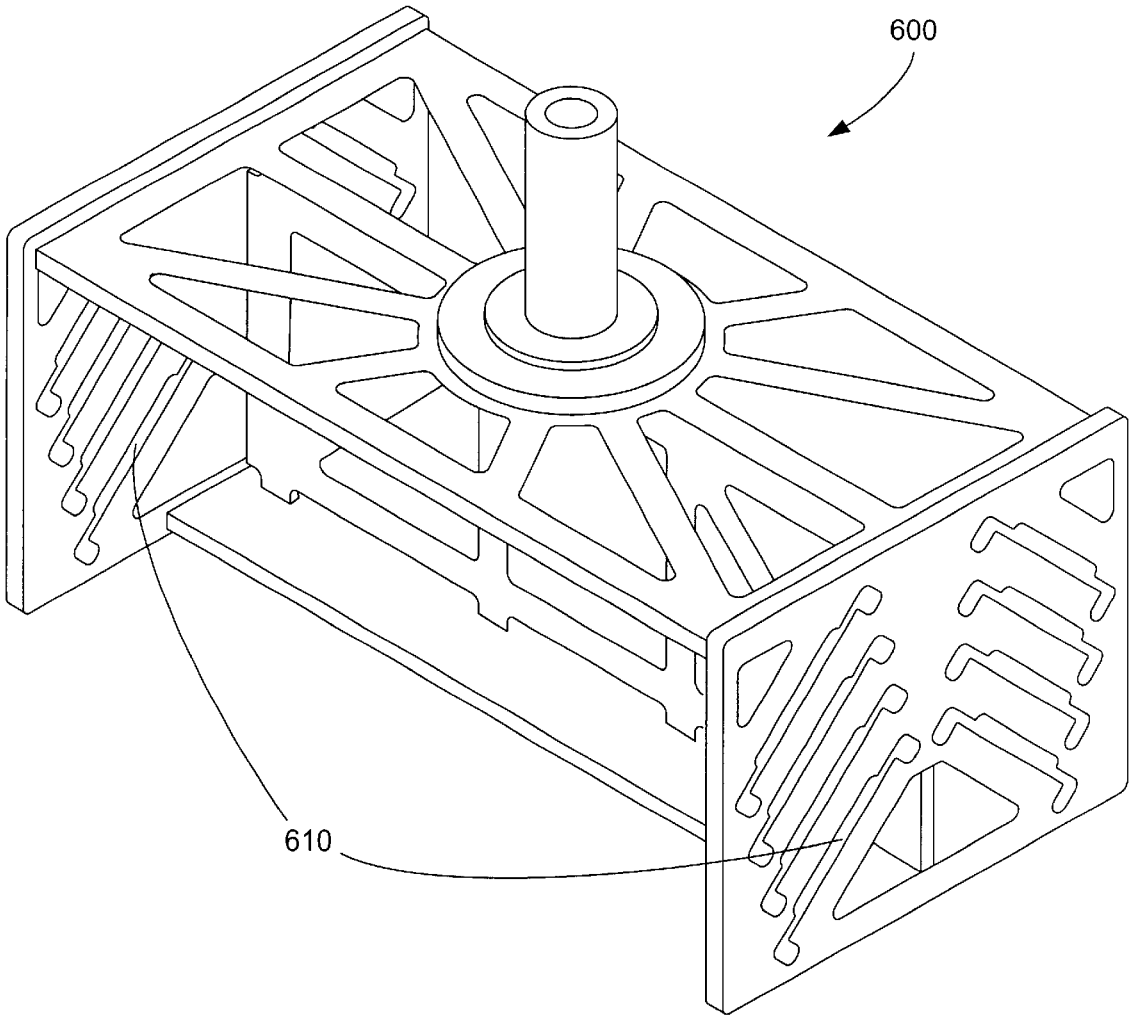
FIG. 6 is a simplified perspective view of a cleaning fixture for a centrifugal IC cleaner that employs IC boats containing IC assemblies, with the IC assemblies being held at an incline from horizontal according to an embodiment of the invention.

In the embodiment of FIG. 6, second cleaning fixture 600 employs an incline of 45 degrees from vertical. In several embodiments, this angle is thought to be a fair compromise between the needs of a higher angle for purposes of reducing the time to fill solvent tank 210 (or increasing the speed with which the cleaning fixture may be lowered into cleaning solution 220) and the desire of a lower angle to facilitate the agitation or centrifugal extraction of cleaning solution 220, depending on the particular configuration of the cleaning fixture. However, other angles of inclination, ranging from a slight tilt from horizontal to a fully vertical position, will also work well, such as the 30 degrees utilized in first cleaning fixture 500, or the 90 degrees employed in third cleaning fixture 700.

Both the agitation of flip chip assemblies 100 and the extraction of cleaning solution 220 from flip chip assemblies 100 are affected by the angle of incline and the angle of orientation with respect to the rotational axis of the particular cleaning fixture. For example, third cleaning fixture 700 provides excellent extraction because the parts are held radially with respect to the rotational axis. However, that same fixture provides poor agitation because of that same orientation. Agitation may be improved, however, by reducing the angle of incline, at the possible expense of a reduced rate of filling planar space 140.

Figure 5:
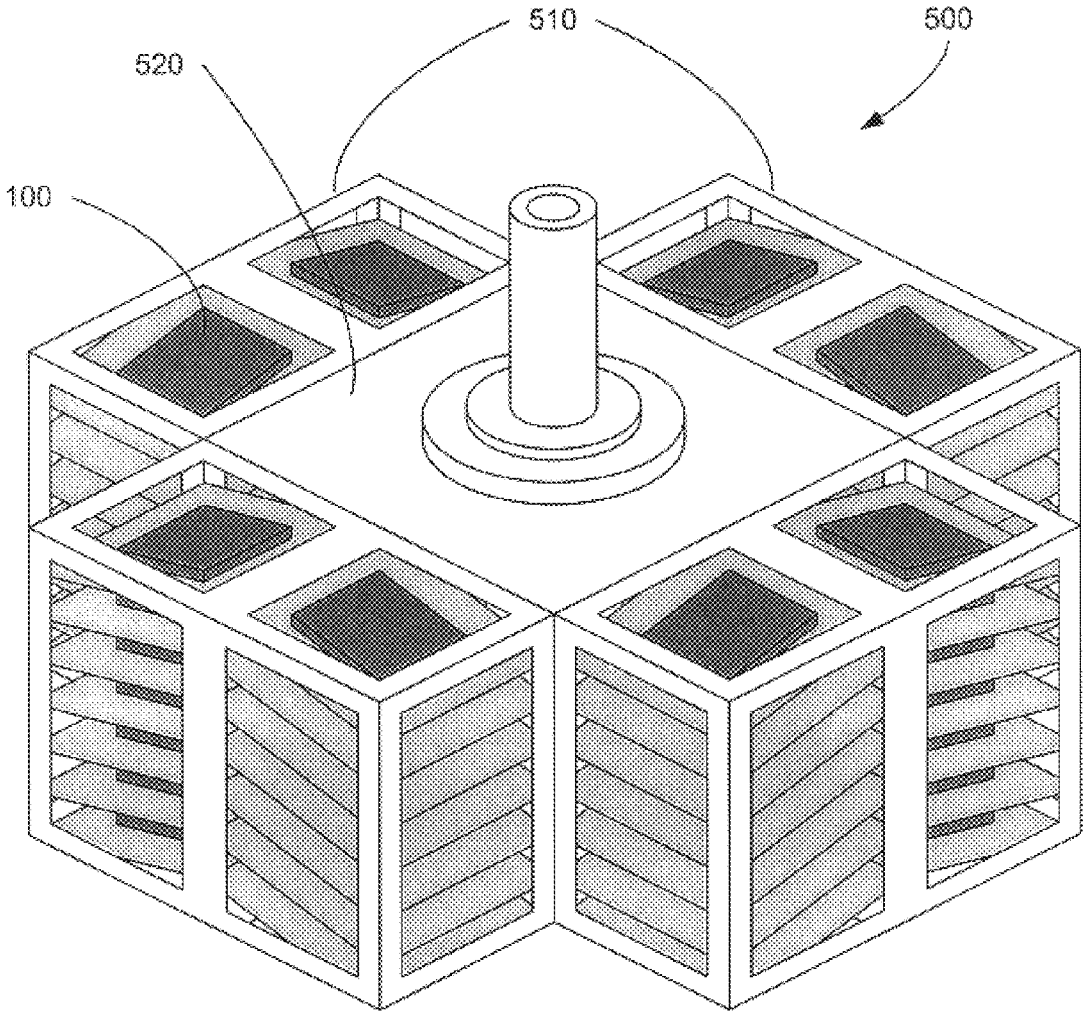
FIG. 5 is a simplified perspective view of a cleaning fixture for a centrifugal IC cleaner that employs cassettes that hold IC assemblies at an incline from horizontal according to an embodiment of the invention.
Figure 7:
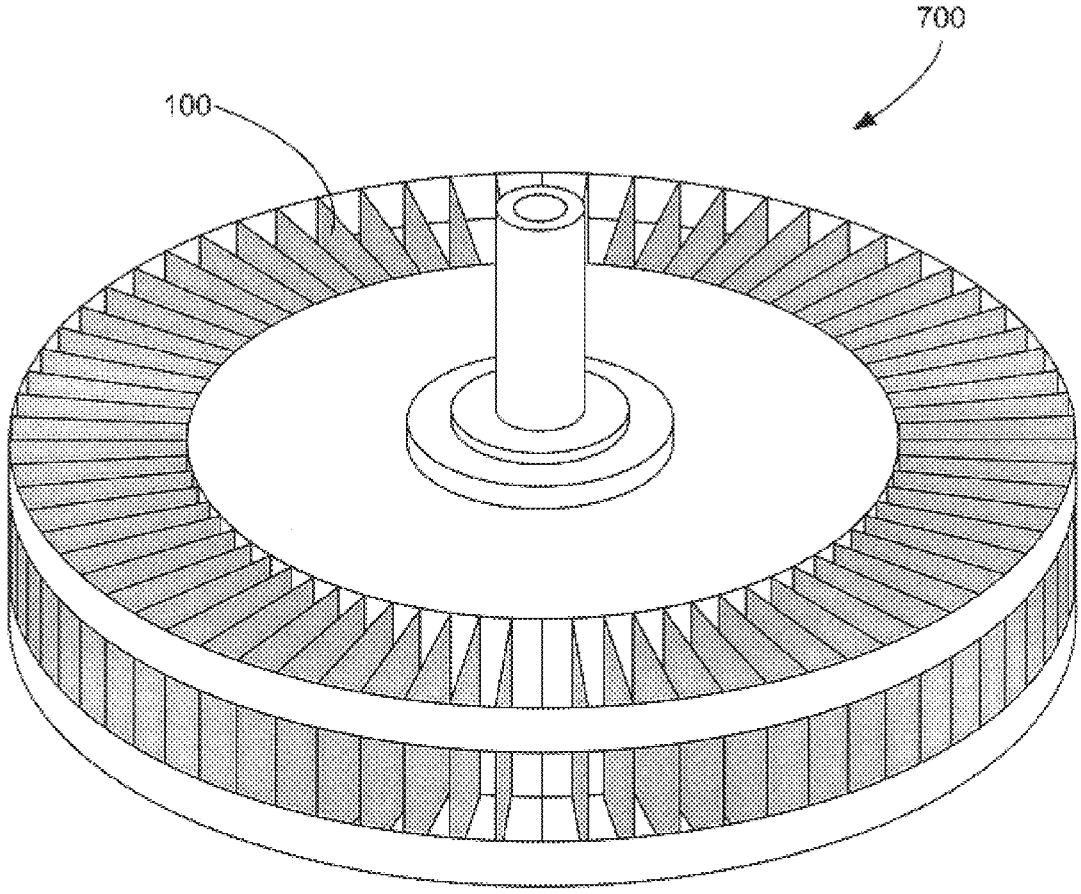
FIG. 7 is a simplified perspective view of a cleaning fixture for a centrifugal IC cleaner that holds the IC assemblies directly at an incline from horizontal according to an embodiment of the invention.

Furthermore, each embodiment shown in FIGS. 5, 6, and 7 is not limited to the angle of incline shown for that particular fixture. For example, second cleaning fixture 600 could have been designed to hold flip chip assemblies 100 at an incline of 60 degrees or any other angle deemed necessary for proper cleaning.

Figure 8:
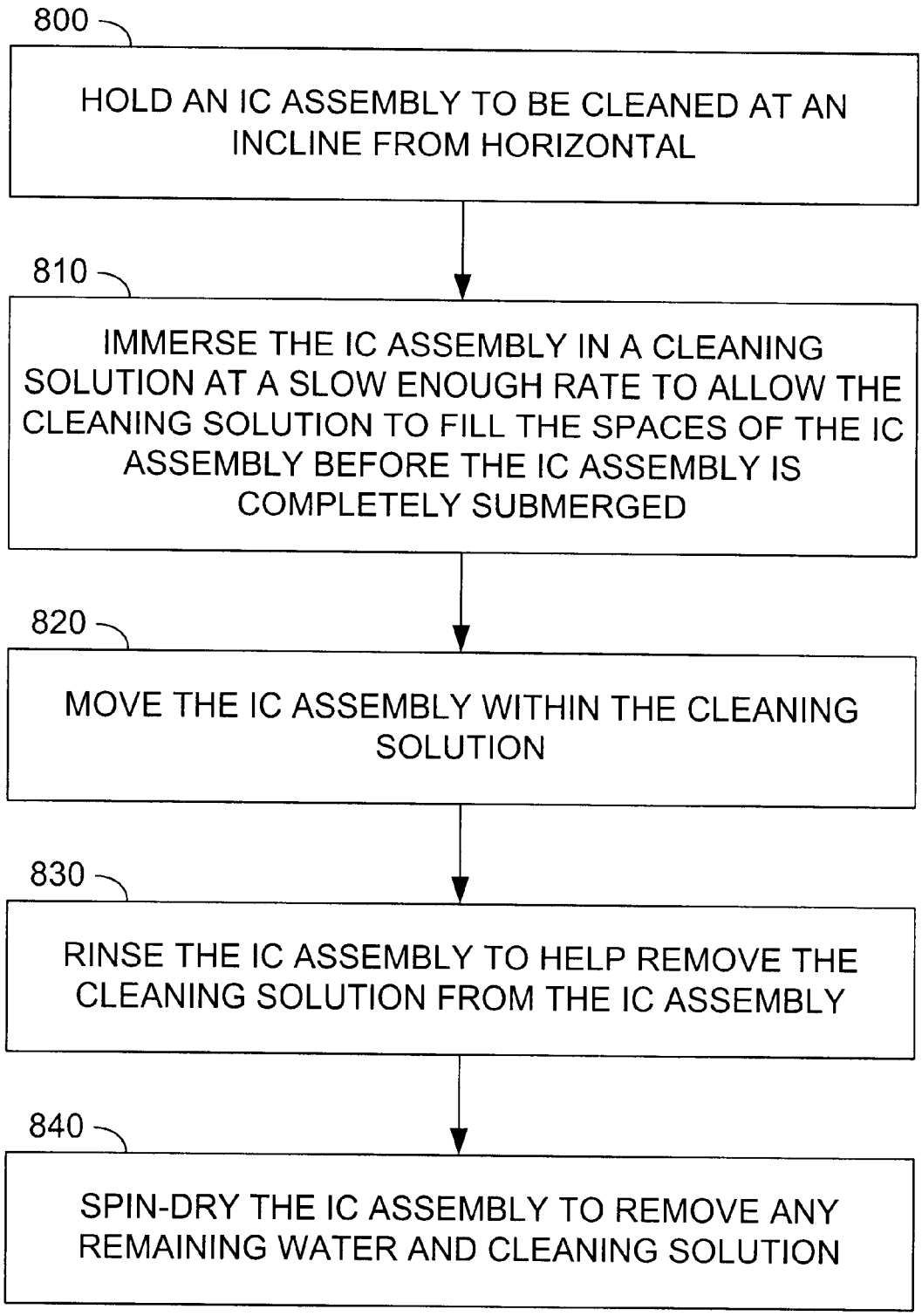
FIG. 8 is a flow chart of a method of cleaning IC assemblies according to an embodiment of the invention.

Additionally, other embodiments of the present invention take the form of a method of cleaning an IC assembly, such as a flip chip assembly, that allows flux residue to be removed from tight spaces of the IC assembly. FIG. 8 displays the steps involved in a method embodiment of the invention. First, the IC assembly to be cleaned, such as a flip chip assembly with a substantially planar space, for example, is held at an incline from horizontal so that the top surface of a bath of cleaning solution coming in contact with the IC assembly may enter the space without submerging the entire perimeter of the space in the cleaning solution (step 800). Next, the IC assembly is immersed in the cleaning solution at a slow enough rate to allow the cleaning solution to fill the space while allowing air within the space to escape or vent without being impeded by the cleaning solution (step 810). The IC assembly should not be completely submerged in the cleaning solution until the space has been filled with the solution. Afterward, the steps of moving (via spinning or agitation) the IC assembly in the cleaning solution (step 820), rinsing the IC assembly with water to help remove the cleaning solution from the IC assembly (step 830), and spin-drying the IC assembly to ensure all cleaning solution and water are extracted from the IC assembly (step 840), are customarily employed.

From the use of embodiments of the present invention, not only has the ability to clean narrow spaces in flip chip assemblies been enhanced greatly, but manufacturing line throughput has been increased significantly. Although the time required to fill the tank of a centrifugal cleaner has been increased due to the time needed to allow the cleaning solution to completely fill the thin space of the IC assembly, the amount of time required for spinning and agitating the IC assembly within the cleaning solution has been reduced dramatically since the cleaning solution reaches all of the flux residue within the space. Current use of embodiments of the invention described herein have allowed a previous cleaning cycle time of 15 minutes to be reduced to less than 12 minutes, thus boosting cleaning process throughput by about 25%. Since the IC cleaning process is a significant limiting factor in overall IC manufacturing throughput, such a reduction in the cleaning process cycle time increases the capacity of the entire IC manufacturing line substantially.

What is claimed is:

1. An integrated circuit assembly cleaning apparatus, comprising:

means for holding an integrated circuit assembly at an incline from horizontal; and means for immersing the integrated circuit assembly in a bath of a cleaning solution at a controllable rate so that no air is trapped inside the integrated circuit assembly, whereby the cleaning solution contacts all surfaces of the integrated circuit assembly prior to total submergence of the integrated circuit assembly in the cleaning solution.

2. The integrated circuit assembly cleaning apparatus of claim 1, further comprising:

means for moving the integrated circuit assembly within the cleaning solution;

means for rinsing the cleaning solution from the integrated circuit assembly; and means for spin-drying the integrated circuit assembly.

3. The integrated circuit assembly cleaning apparatus of claim 1, wherein the holding means comprises:

an integrated circuit assembly cassette that holds the integrated circuit assembly; and a carousel that holds the integrated circuit assembly cassette.

4. The integrated circuit assembly cleaning apparatus of claim 1, wherein the holding means comprises:

a cleaning fixture that holds an integrated circuit assembly boat that retains the integrated circuit assembly throughout portions of an integrated circuit assembly manufacturing process.

5. The integrated circuit assembly cleaning apparatus of claim 1, wherein the holding means comprises:

a cleaning fixture that holds the integrated circuit assembly directly.

6. The integrated circuit assembly cleaning apparatus of claim 1, wherein the immersing means comprises:

a solvent tank, within which the holding means is positioned; and a tank-filling mechanism that fills the solvent tank with the cleaning solution at a controllable rate.

7. The integrated circuit assembly cleaning apparatus of claim 1, wherein the integrated circuit assembly is tilted at an incline of approximately 45 degrees from horizontal.

8. A cleaning fixture for a centrifugal cleaner for an integrated circuit assembly, the centrifugal cleaner having a solvent tank and a tank-filling mechanism that fills the solvent tank with a cleaning solution at a controllable rate, the cleaning fixture being positioned within the solvent tank, the cleaning fixture comprising:

an integrated circuit assembly cassette that holds the integrated circuit assembly at an incline from horizontal; and a central carousel that holds the integrated circuit assembly cassette.

9. The cleaning fixture of claim 8, wherein the integrated circuit assembly is tilted at an incline of approximately 45 degrees from horizontal.

10. A cleaning fixture for a centrifugal cleaner for an integrated circuit assembly, the centrifugal cleaner having a solvent tank and a tank-filling mechanism that fills the solvent tank with a cleaning solution at a controllable rate, the cleaning fixture being positioned within the solvent tank, the cleaning fixture comprising:

slots for holding an integrated circuit assembly boat that holds the integrated circuit assembly throughout portions of an integrated circuit assembly manufacturing process, the integrated circuit assembly being tilted at an incline from horizontal.

11. The cleaning fixture of claim 10, wherein the integrated circuit assembly is tilted at an incline of approximately 45 degrees from horizontal.

12. A cleaning fixture for a centrifugal cleaner for an integrated circuit assembly, the centrifugal cleaner having a solvent tank and a tank-filling mechanism that fills the solvent tank with a cleaning solution at a controllable rate, the cleaning fixture being positioned within the solvent tank, the cleaning fixture comprising:

a slot for holding an integrated circuit assembly directly, the integrated circuit assembly being tilted at an incline from horizontal.

13. The cleaning fixture of claim 12, wherein the integrated circuit assembly is tilted at an incline of approximately 45 degrees from horizontal.

14. A method of cleaning an integrated circuit assembly, comprising the steps of:

holding the integrated circuit assembly at an incline from horizontal; and immersing the integrated circuit assembly in a bath of a cleaning solution at a controllable rate so that no air is trapped inside the integrated circuit assembly, whereby the cleaning solution contacts all surfaces of the integrated circuit assembly prior to total submergence of the integrated circuit assembly in the cleaning solution.

15. The method of claim 14, further comprising the steps of:

moving the integrated circuit assembly within the cleaning solution;

rinsing the cleaning solution from the integrated circuit assembly; and spin-drying the integrated circuit assembly.

16. The method of claim 14, wherein the integrated circuit assembly is tilted at an incline of approximately 45 degrees from horizontal.

* * * * *